US005626032A

United States Patent [19]

Neblett

[11] Patent Number: 5,626,032

[45] Date of Patent: May 6, 1997

[54] CYCLOTHERMIC CONVERTER VANE PUMP AND IMPELLER SYSTEM

[76] Inventor: Ian G. Neblett, 125 Terrosa Road, Markham, Ontario, Canada, L3S 2R1

[21] Appl. No.: 467,978

[22] Filed: Jun. 6, 1995

[51] Int. Cl.[6] ..... F01C 1/00; F25B 1/00

[52] U.S. Cl. ..... 62/513; 62/116; 418/219

[58] Field of Search ..... 418/219, 228–232; 62/116, 513

[56] References Cited

U.S. PATENT DOCUMENTS

| | | | |
|---|---|---|---|
| 1,743,977 | 1/1930 | Petersen | 418/219 |
| 3,902,829 | 9/1975 | Burrowes | 418/219 X |
| 4,028,028 | 6/1977 | Fuchs, Jr. | 418/232 X |

*Primary Examiner*—William E. Wayne
*Attorney, Agent, or Firm*—Eugene J. A. Gierczak

[57] ABSTRACT

A system having a matched vane compressor and impeller is described for use in either a hydraulic system or in a two phase air conditioning system. The impeller is matched to the compressor to return work to the compressor through a shaft or gearbox. The compressor is a vane compressor having longitudinally reciprocating vanes carried in a slotted disc between matched, opposed cam faces forming a series of variable geometry chambers which draw in and expel working fluid during rotation of the shaft. Compression is achieved by exposing the fluid in the chambers to high pressure fluid while the volume of the chamber is not changing. A pressurizing port is placed tangentially to the chambers for this purpose. The impeller also makes use of tangentially disposed pressure ports to expose the turning pockets of a drum to higher pressure. The outlet of the impeller only skims off a surface layer of the liquid in the pockets, reducing the volumetric through flow of the impeller while it returns work to the compressor. These systems can be utilized in hydraulic or thermal applications.

16 Claims, 8 Drawing Sheets

CYCLOTHERMIC CONVERTER VANE PUMP AND IMPELLER SYSTEM

FIELD OF INVENTION

The present invention relates to the field of vane compressors and impellers such as may be used as hydraulic pumps or air conditioning compressors. In particular it relates to a vane compressor having longitudinally reciprocating vanes governed by two parallel, opposed cam surfaces in which pressurization is achieved not by mechanical squeezing of the working fluid but rather by exposure of contained fluid at low pressure to a source of fluid at high pressure when said components are used in conjunction with the systems described. It will act as a power unit to provide power to operate one or more secondary loads.

BACKGROUND OF THE INVENTION

Reciprocating vane pumps have been know for many years. They come in a number of varieties, in which either the vanes reciprocate vertically, or reciprocate radially in the space intermediate eccentrically disposed cylinders, or between non-cylindrical surfaces disposed to define lobate surfaces, such as might be generated from hypocyclic and epicyclic curves. The common factor in all cases is the use of a variable geometry chamber formed between an adjacent pair of vanes, a pair of opposed end walls swept by the vanes, and a pair of opposed inner and outer walls, either or both of which may also be swept by the vanes. The more recent scroll compressors are able to achieve this variable geometry chamber with only four walls, rather than six, but nonetheless operate on the same general principle. In general the chamber volume varies to draw in fluid in one phase of revolution, then is progressively reduced to compress the fluid and expel it through one or more exhaust ports. In all cases it is the mechanical movement of the chamber wall which actually compresses the fluid.

An example of this kind of device is shown in U.S. Pat. No. 2,020,611 granted to Knapp. Knapp described a vertically, or longitudinally reciprocating vane compressor in which a series of vanes 19 reciprocate between two vertically, or longitudinally, undulating camming surfaces 34 and 35. Working fluid is drawn in, and in turn expelled, through ports 35 and 36, and, in particular, via ports 37*a* and 38 located in the camming surfaces themselves.

U.S. Pat. No. 4,653,603 to DuFrene also shows a vertically reciprocating vane compressor for use with hydraulic fluid that may work in either clockwise or counterclockwise direction and is provided with a steering return-to-neutral system.

Examples of the eccentric cylinder of vane compressors are shown in U.S. Pat. No. 2,303,589 and U.S. Pat. No. 2,280,271, both to Sullivan. Another patent granted to Sullivan, U.S. Pat. No. 2,280,272 illustrates two variations of arcuate lobe vane compressors, particularly as illustrated in FIGS. 2 and 3 thereof.

An interesting variation on the vertically reciprocating vane compressor is shown in U.S. Pat. No. 4,439,117 to Bunger in which the phase angle, and hence volumetric displacement of the pump can be altered. U.S. Pat. No. 4,566,869 to Pandeya et al. teaches a reversible arcuate lobe multivane vane compressor, with the known radially reciprocating vanes. U.S. Pat. No. 5,064,362 to Hansen shows another variation of pump with radially reciprocating vanes operating between a cylindrical rotor and elliptical stator. In all of these cases compression of the working fluid is achieved by reducing the size of the chambers into which the working fluid is periodically drawn and whence it is subsequently expelled.

DESCRIPTION OF THE INVENTION

The present invention discloses a vane compressor and impeller system for use with hydraulic systems or with two phase refrigeration and air conditioning systems, the compressor and impeller inter-linked such that rotation of one is transmitted to the other. In a first aspect of the invention there is disclosed a reciprocating vane pump comprising a stator; a rotor for riding within that stator; the rotor comprising a partition having slots and slidable vanes for sliding engagement within those slots; the stator assembly comprising first and second camming surfaces bracketing the partition; the slidable vanes disposed intermediate, and for riding engagement of those camming surfaces; the stator assembly having an inner wall and an outer wall and a gallery intermediate the inner and outer walls; the camming surfaces each comprising at least an intake sector, a pressurizing sector, and an exhaust sector; the stator assembly comprising a pressurizing port opening upon the pressurizing sector and communicating with the gallery whereby the pressurizing sector is exposed to pressure prevailing in said gallery.

In a second aspect of the invention the pressurizing passage of the reciprocating vane pump traverses the inner wall; the inner wall comprises an inner face; and the pressurizing passage comprises a wall disposed tangentially to the inner face.

In a further aspect of the above invention there is disclosed a reciprocating vane compressor in which each intake sector is adjacent a region of tangential contact of that camming surface with the partition and the intake sector has inlet ports communicating with a source of low pressure fluid; each exhaust sector is adjacent a region of tangential contact of that camming surface with the partition and the exhaust sector is also adjacent a sector of the inner wall having at least one exhaust port communicating with the gallery, and the gallery having an high pressure outlet; the camming surface, partition, inner wall, rotor and vanes defining a succession of variable geometry rotating chambers whereby fluid is drawn into each chamber through the inlet ports, compressed by exposing each chamber to the pressurizing port, and expelled from each chamber through the exhaust port.

In another aspect of the invention there is a longitudinally reciprocating vane compressor for drawing in a fluid from a low pressure source and expelling that fluid through a higher pressure discharge, the compressor comprising a stator; a rotor for riding within the stator; the stator comprising at least one camming surface; the rotor comprising a set of longitudinally reciprocating vanes for riding upon the camming surface; the camming surface comprising at least an intake sector, an exhaust sector and a null sector between the intake sector and the exhaust sector; the stator comprising a pressurizing port adjacent the null sector, the pressurizing port being in fluid communication with the high pressure discharge, whereby the null sector is exposed to the pressure prevailing at the high pressure discharge.

In yet another aspect of the invention one finds a mated vane compressor pump and impeller system for operation between a low pressure source of fluid and a high pressure fluid system that system comprising a vane compressor; an impeller; a linkage between the vane compressor and the impeller for inter-linking the motion thereof; the vane compressor comprising a compressor stator and a compressor rotor for riding therein; the compressor rotor comprising a partition having slots and slidable vanes for sliding engagement within those slots; the compressor stator assembly comprising first and second camming surfaces bracketing the partition; the slidable vanes disposed intermediate, and for riding engagement of the camming surfaces; the compressor stator having an inner wall and an outer wall and a gallery intermediate the inner and outer walls; the camming surfaces each comprising at least an intake sector, a pressurizing sector, and an exhaust sector; the compressor stator assembly comprising a pressurizing port opening upon the pressurizing sector and communicating with the gallery whereby the pressurizing portion is exposed to pressure prevailing in the gallery; an impeller stator and an impeller rotor for riding therein; the impeller stator comprising an inner wall and an outer wall and an inlet manifold therebetween for receiving fluid from the high pressure system; the impeller rotor comprising a drum which comprises fluid pockets; the impeller stator inner wall comprising at least one channel communicating with the manifold for carrying fluid to the drum; the impeller stator comprising at least one outlet passage for discharging fluid from the drum to the source; the impeller stator inner wall comprising an inner face having a least one intake portion, at least one outlet portion, and a null portion therebetween and in which the channel is disposed tangentially to said inner face.

DESCRIPTION OF THE ILLUSTRATIONS

Figure 2:
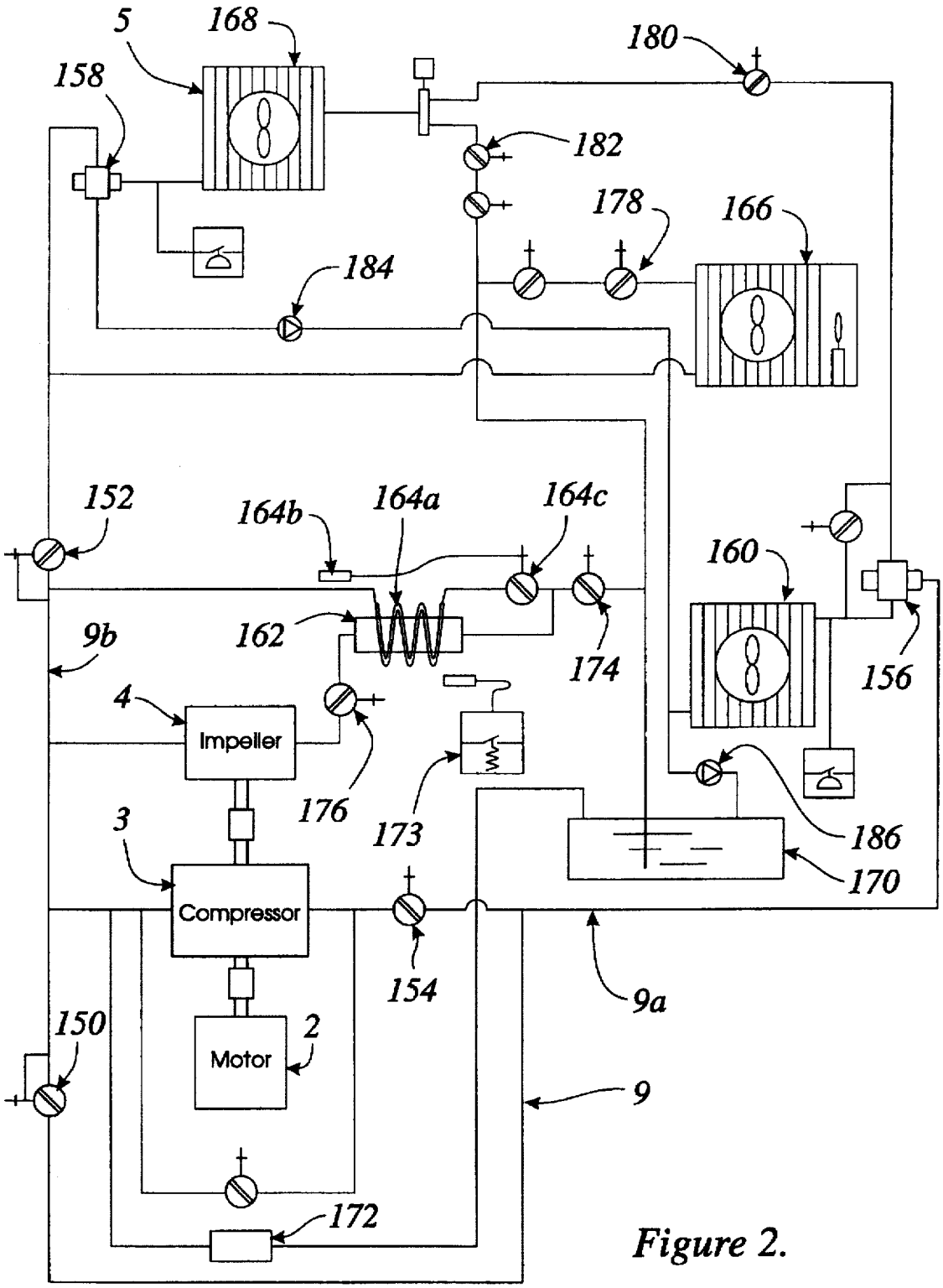
FIG. 2 is a schematic of an air conditioning and heat pump system incorporating the present invention.
Figure 3A:
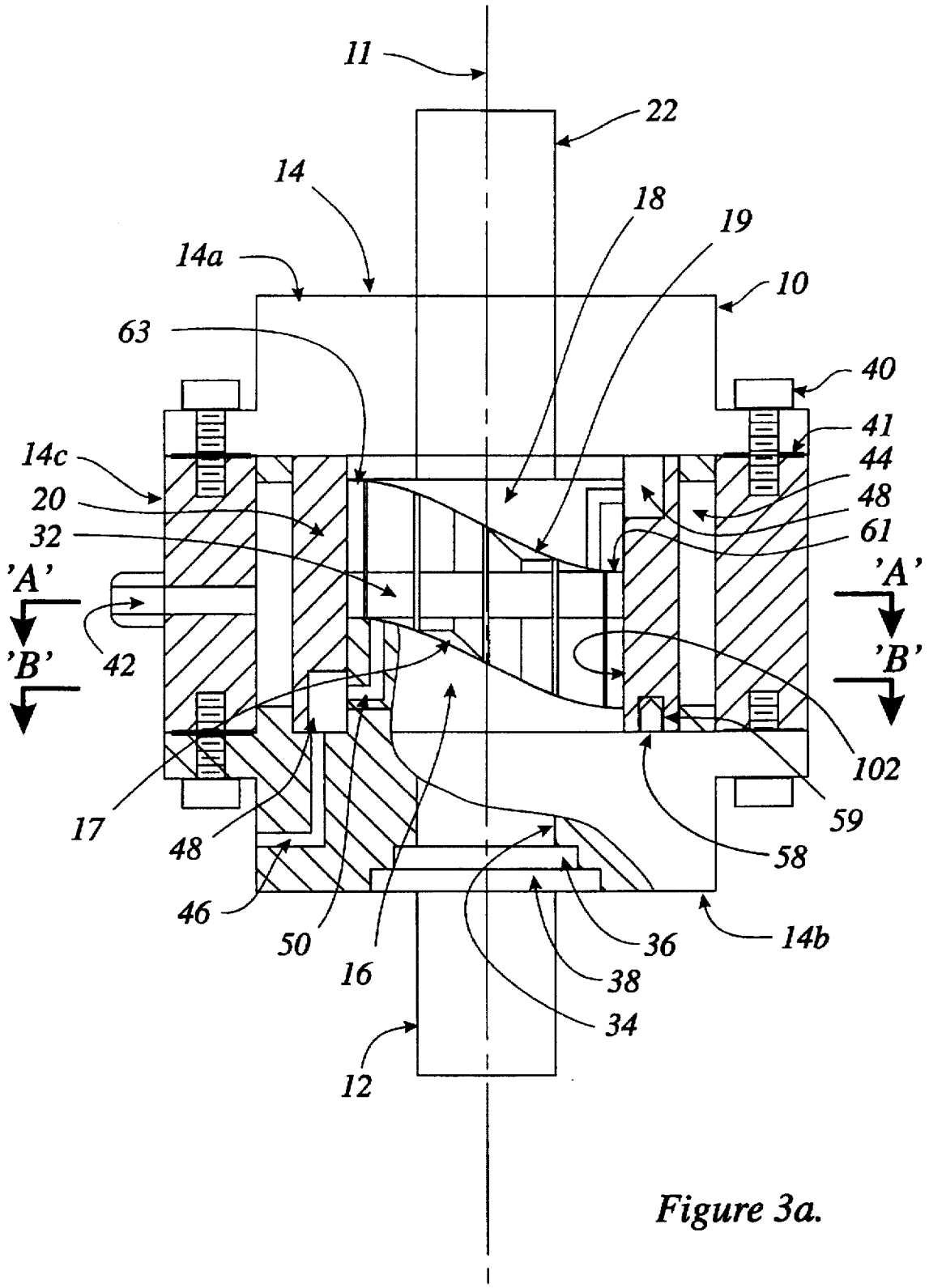
Figure 3B:
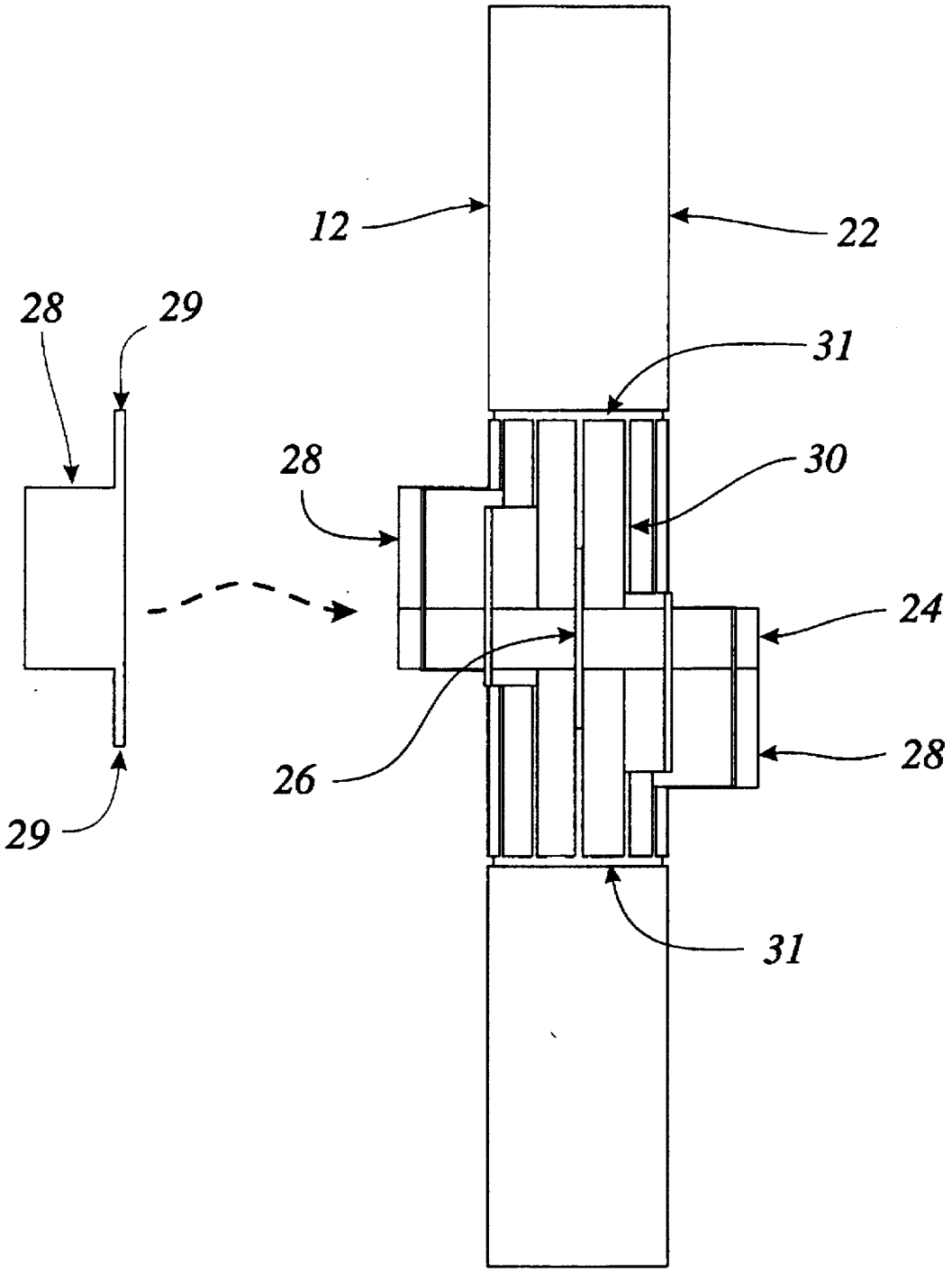
Figure 3C:
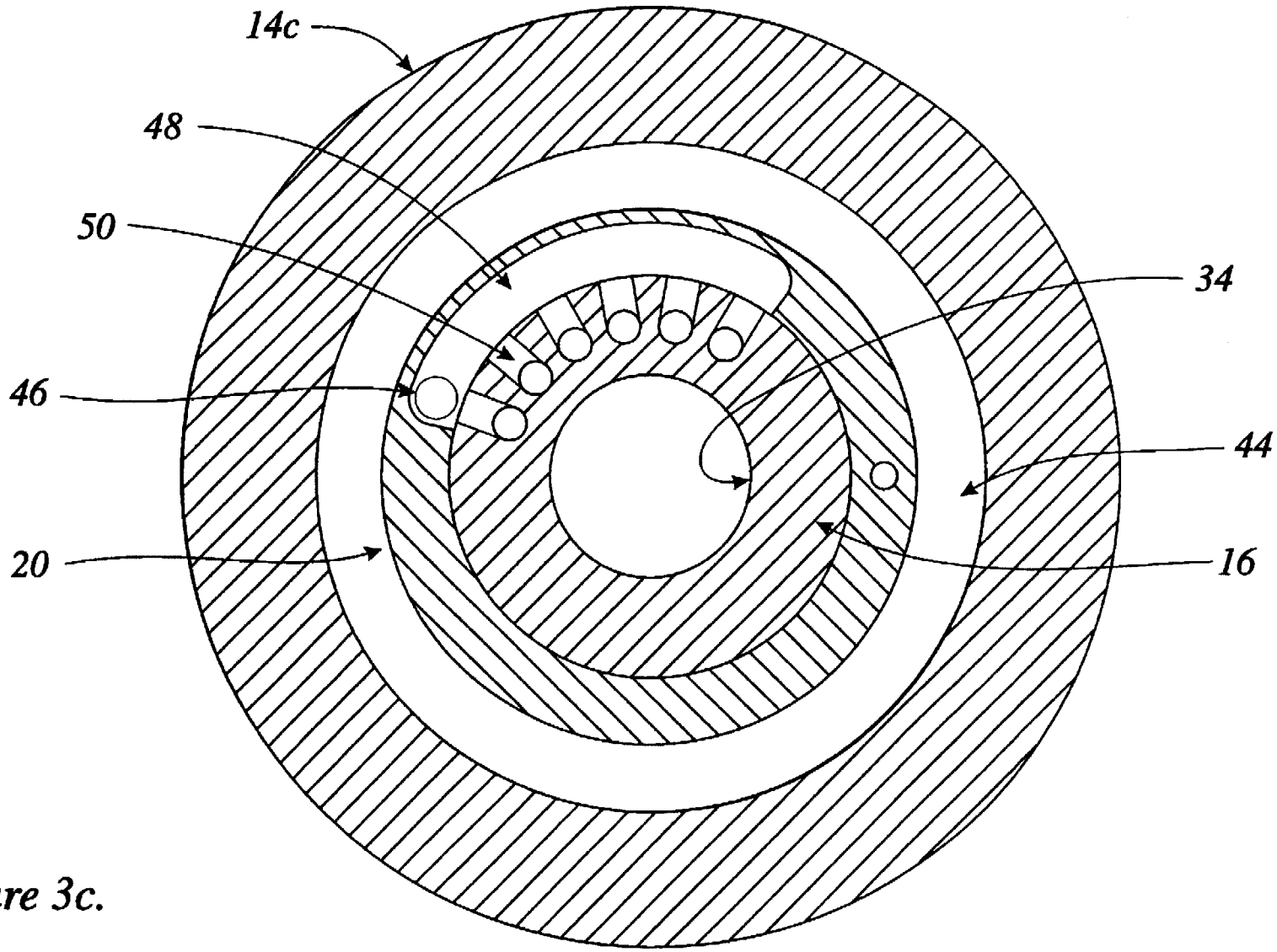

FIG. 3 comprises FIG. 3*a*, 3*b*, and 3*c*. FIG. 3*a* is a partially cross sectional view in profile of the compressor of FIG. 2. A ring casing of the present invention has been shown in section to reveal the features of a rotor and co-operating cam system. Part of a back shell housing incorporating that cam system has also been shown in section to reveal internal features, such as fluid passages. FIG. 3*b* shows a compressor rotor assembly of the present invention as removed from the corresponding stator. FIG. 3*c* provides greater detail of internal passages of the compressor of the present invention in a vertical section taken on 'B—B' of FIG. 3*a*, with the rotor assembly of FIG. 3*b* removed.

Figure 4:
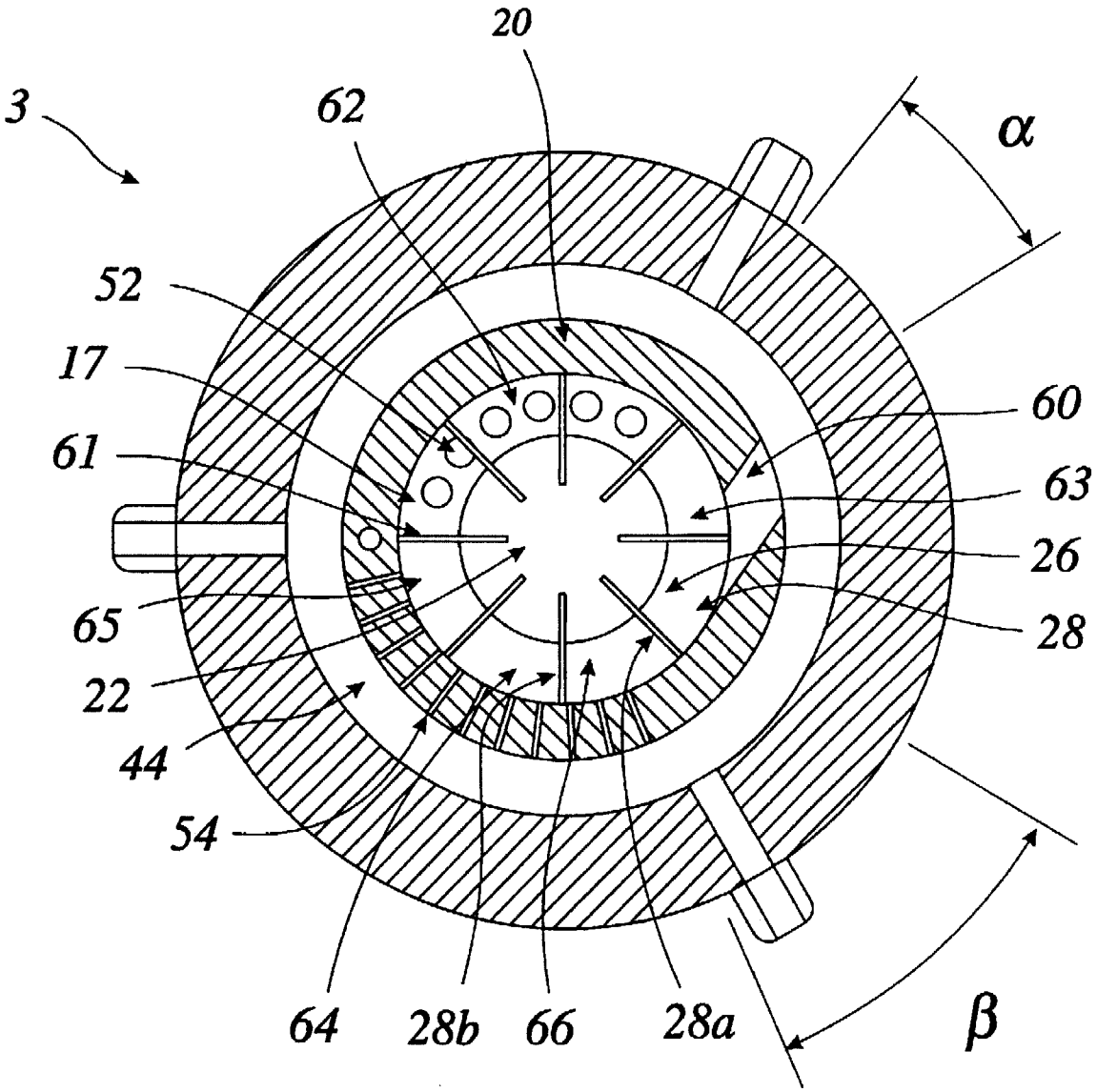

FIG. 4 is a cross sectional view taken from above of the compressor unit of the present invention taken on section 'A—A' of FIG. 3*a*.

Figure 5:
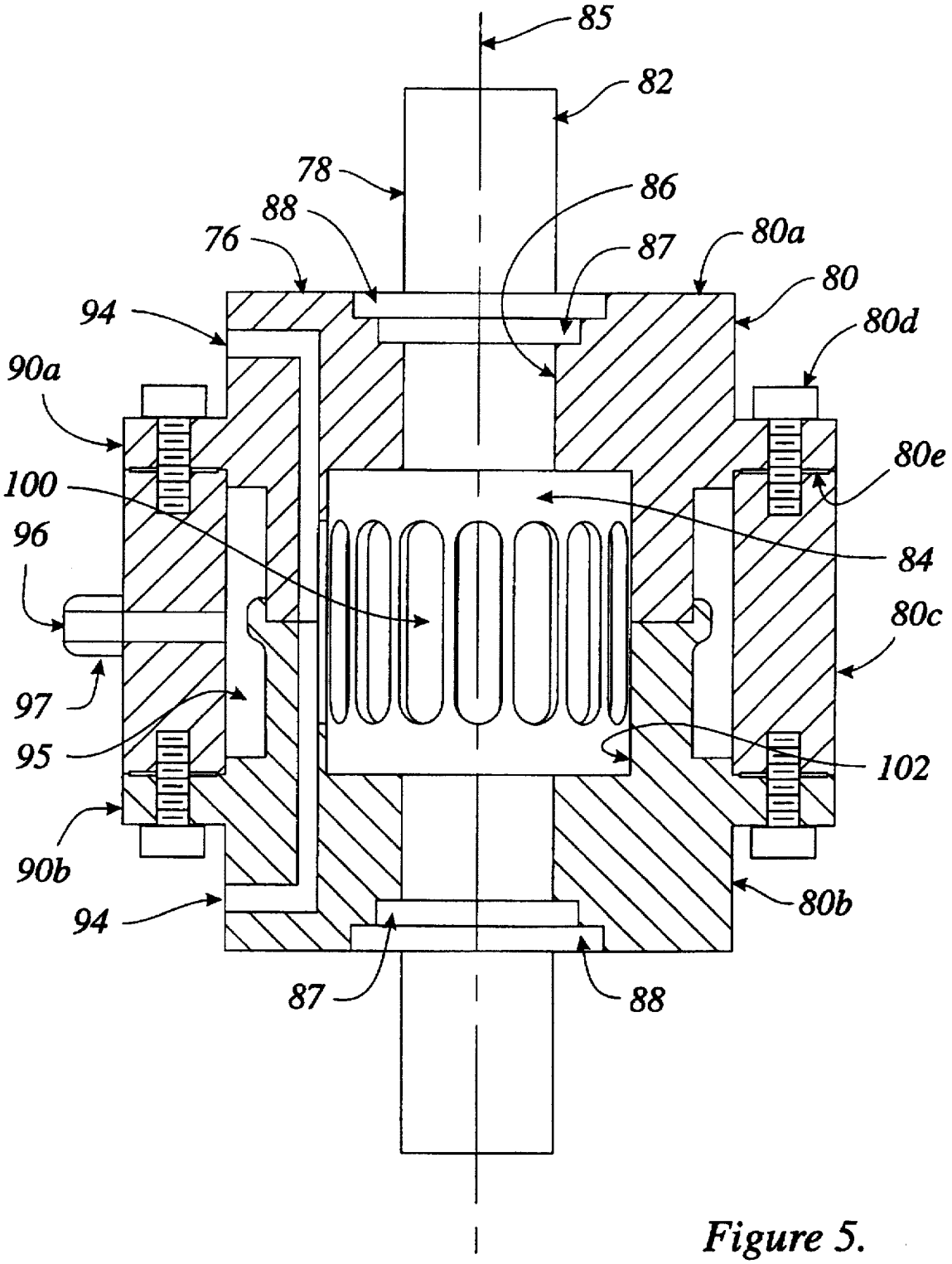

FIG. 5 is a cross sectional profile view of the impeller of FIG. 4.

Figure 6:
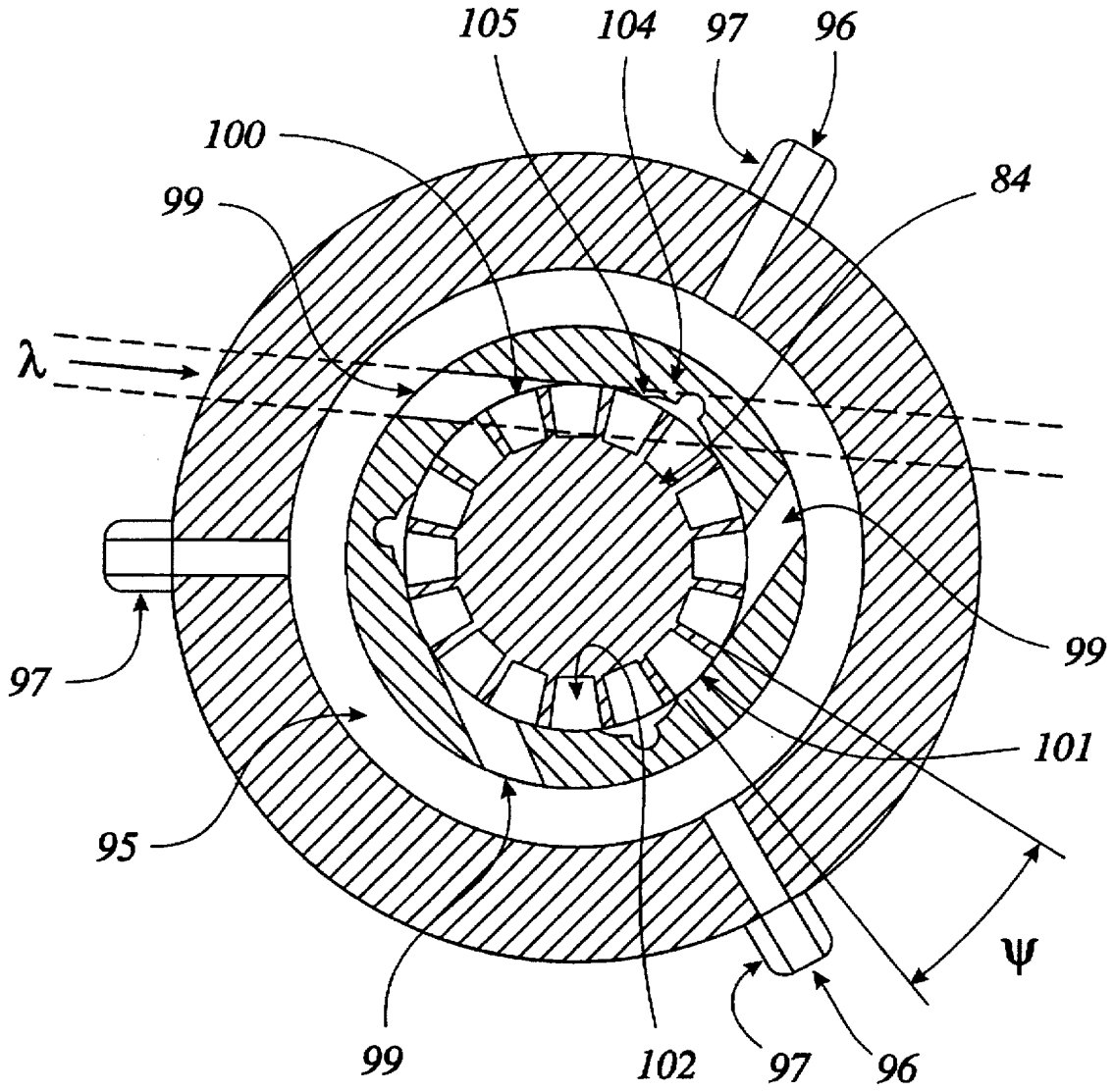
Figure 1:
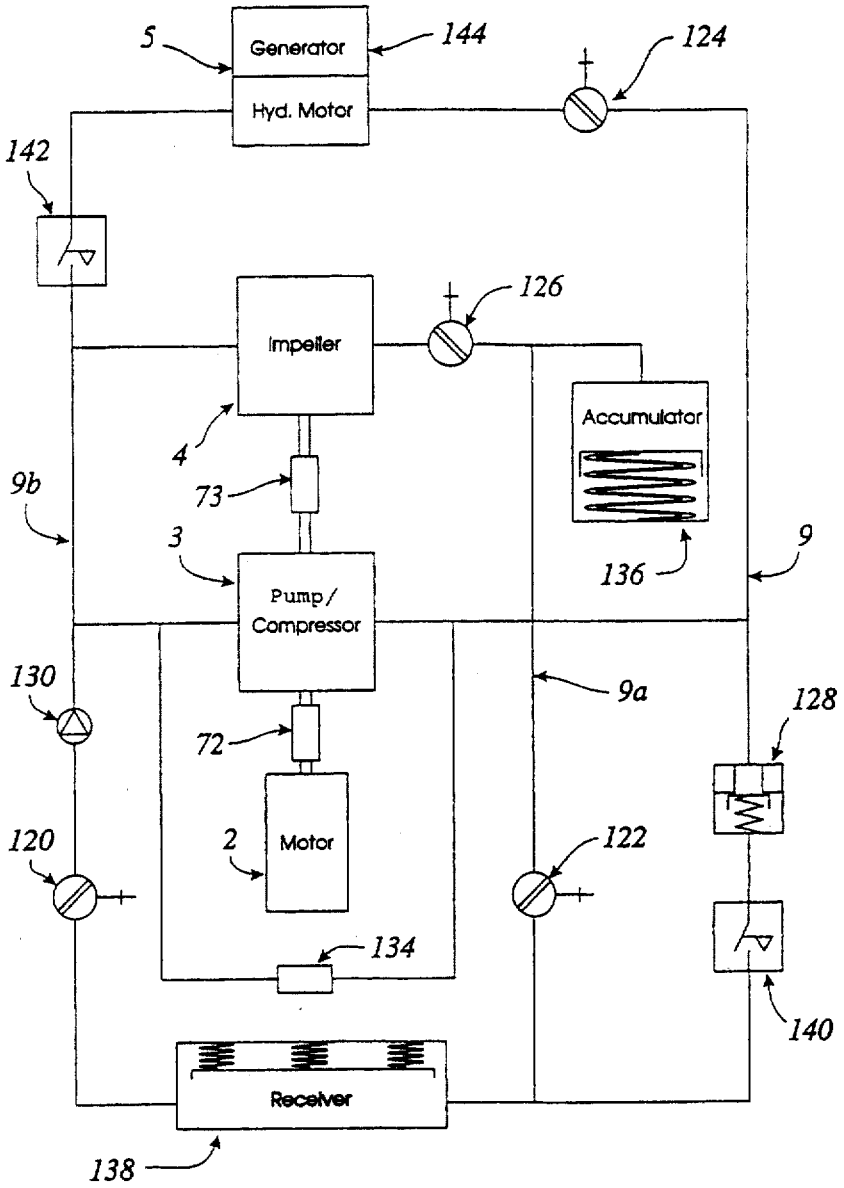
Figure 2:
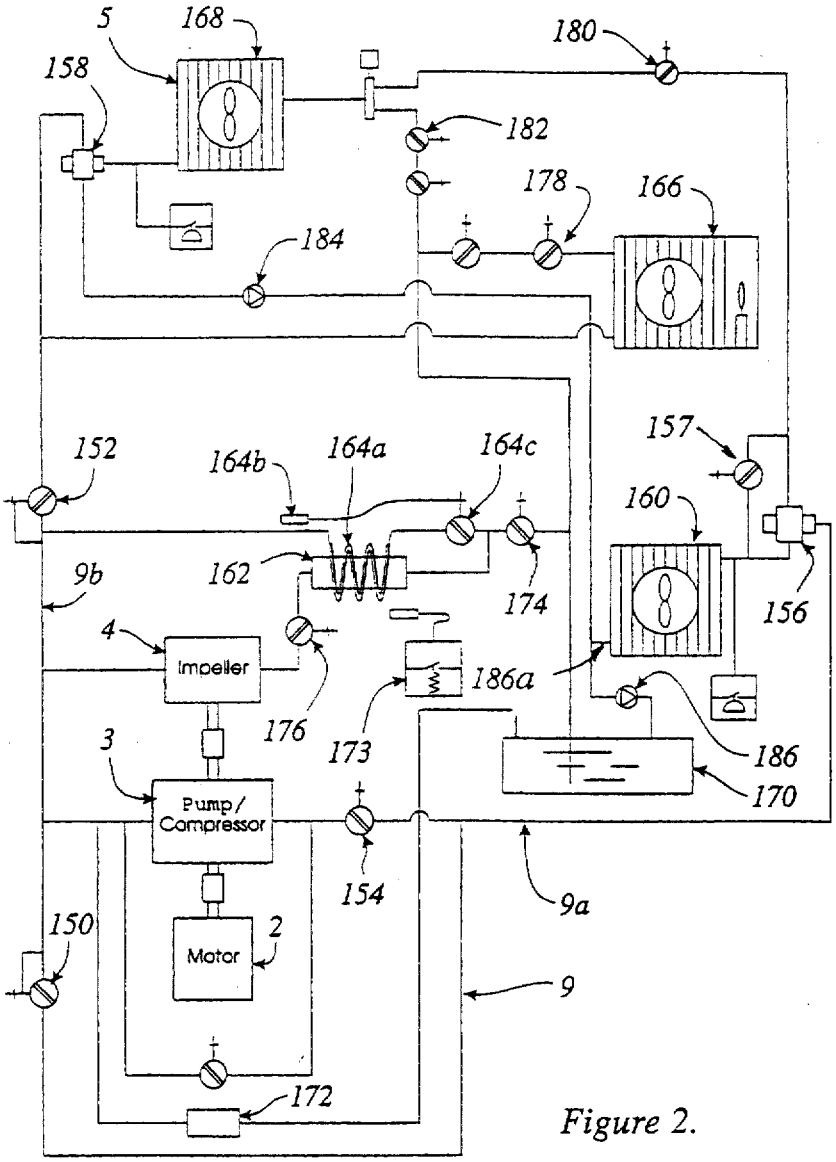
Figure 4:
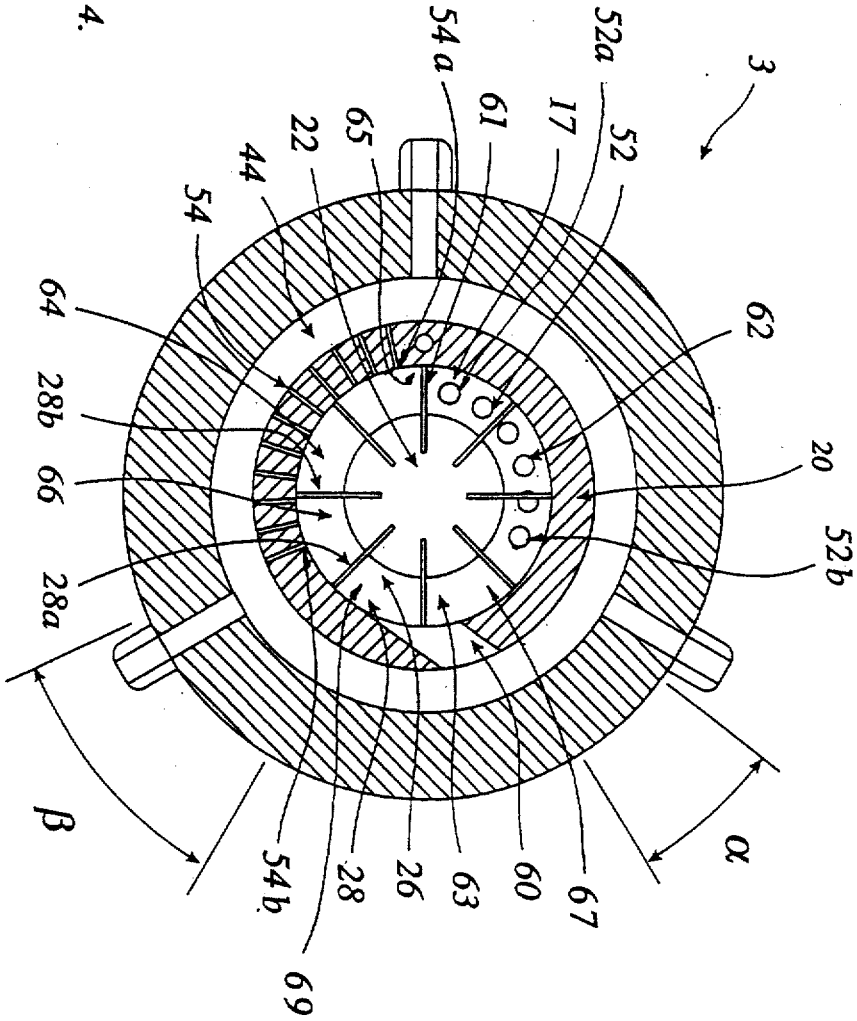

FIG. 6 is a cross sectional view from above of the impeller of the present invention.

DETAILED DESCRIPTION OF THE PREFERRED EMBODIMENT

Figure 1:
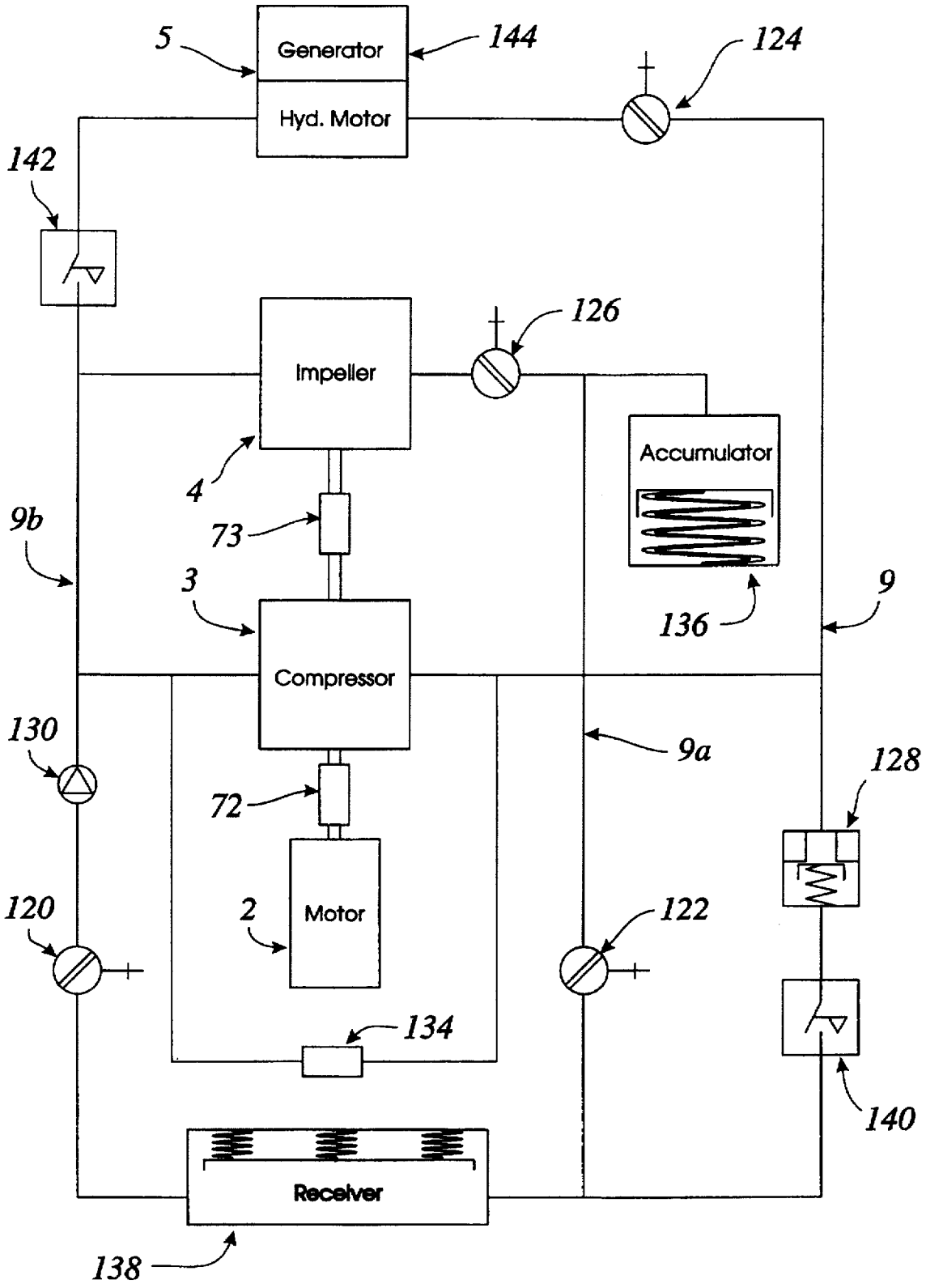
FIG. 1 is a schematic of a hydraulic pump system incorporating the present invention.

An hydraulic system comprising the present invention shown in the schematic of FIG. 1 and an air conditioning or refrigeration system also comprising features of the present invention shown in the schematic of FIG. 2 indicate several common features. Both FIG. 1 and FIG. 2 show a motor 2, a compressor 3, an impeller 4, a load 5, and piping 9, being high pressure lines 9*a* and low pressure, or return lines 9*b*.

Compressor 3 is best illustrated in FIGS. 3 and 4 hereof. Compressor 3 is a longitudinally reciprocating vane pump. It comprises a stator assembly 10 having a longitudinal axis 11, and a rotor assembly 12 carried within the stator assembly for rotation therein about axis 11.

Stator assembly 10 comprises a housing 14 having an upper housing shell 14*a*, a lower housing shell 14*b*, and a ring casing 14*c* intermediate those upper and lower shells; a lower cam pedestal 16 having a first camming surface 17, an upper cam pedestal 18 having an upper camming surface 19, and a cylindrical manifold head 20.

Rotor assembly 12 comprises a shaft 22 having a medial radially extending disk, bulkhead, or partition 24, which itself has an array of 8 radially extending slots 26 on 45 degree angular pitch centres. Slots 26 are disposed for close, sliding engagement of a set of vertically reciprocating vanes 28, or chamber isolators, wherein the vertical direction is assumed to coincide with longitudinal axis 11. As seen in FIG. 3*b* shaft 22 comprises vertical slots 30 which guide, restrain, and provide a close fitting seal about, the radially inner edge of vanes 28. Vanes 28 are also provided with vertically extending wings 29 which ride within slots 30 and serve to guide vanes 28 without jamming. Slots 30 intersect circumferential communicating channels 31.

Shaft 22 is of a size chosen to fit in close tolerance with aligned cylindrical through holes 34 bored in upper and lower shells 14*a* and 14*b*. Bearings 36 and seals 38 locate about shaft 22. Retaining ring 14*c* is located intermediate upper shell 14*a* and lower shell 14*b* concentrically about axis 11 and is held in place by cap screws 40, which also compress gaskets 41. Retaining ring 14*c* has at least one outlet passage 42 whence working fluid may exit compressor 3, for example to high pressure lines 9*a*.

The inner diameter of the cylindrical manifold head 20 is chosen for close engagement of the outer diameter of camming pedestals 16 and 18 respectively such that manifold head 20 is concentric about axis 11. The outside diameter of manifold head 20 is comfortably less than the inner diameter of retaining ring 14*c*, leaving an annular space, or gallery 44 therebetween. Cylindrical head manifold 20 acts as an inner wall, or partition, fully contained within shell 14, and surrounding rotor 12.

Inlet passages 46, shown in the scrap section of FIG. 3*b*, extend through the upper and lower housing shells 14*a* and 14*b*, first horizontally, then vertically, to give onto an inlet manifold chamber 48, which chamber extends around an arcuate sector of cylindrical manifold head 20, as illustrated in FIG. 3*c*. An array of dog-legged transfer passages 50 are disposed to carry fluid from chamber 48 to outlet ports 52 located in camming surfaces 17 and 19 respectively. Upper and lower housing shells 14*a* and 14*b* are identical, but are mounted in vertical opposition, 180 degrees out of phase such that camming surfaces 17 and 19 are in constant, spaced apart relationship.

As shown in FIG. 4, cylindrical manifold head 20 also comprises two arrays of outlet ports 54 which extend radially from its inner face, adjacent rotor 12, to communicate with gallery 44. In the preferred embodiment there are ten such ports in each array, being rectangular slots on 10 degree centres over a total arc of 90 degrees. The location of these slots relative to camming surfaces 17 and 19 is controlled by indexing pins 58, one each in upper shell 14*a* and lower shell 14*b*, which locate in blind locating holes 59 drilled in cylindrical manifold head 20.

Finally, cylindrical manifold head 20 comprises pressurizing port 60. Pressurizing port 60 is cut through the manifold head 20 to communicate with gallery 44, and is cut such that the projection of one side of the port 60 is substantially tangential to the outer diameter of shaft 22 and the other, parallel, side of the slot is substantially tangential to the inner wall of the cylinder manifold head. The arcuate separation of the inlet ports from the pressurizing port, shown as greek letter alpha, exceeds the pitch between vanes 28. The arcuate separation between pressurizing port 60 and the exhaust port, greek letter beta, is also greater than the pitch between vanes 28 or less than the pitch between vanes 28 but is at a neutrally high pressure.

Camming surfaces 17 and 19 have constant radial width but undulate longitudinally to cause longitudinal reciprocation of vanes 28, that is to say, reciprocation parallel to axis 11, as rotor 12 rotates relative to stator 10 and as vanes 28 ride upon surfaces 17 and 19. During this longitudinal reciprocation wings 29 move within slots 30, and oil that would otherwise be trapped in those slots circulates through communicating channels 31. Oil dispaced by one vane is taken up by a diametrically opposed vane. Camming surfaces 17 and 19 have several features of note. First, at any given angle about axis 11 the surface of each camming surface is perpendicular to axis 11 in the radial direction. This ensures that the flat ends of vanes 28 meet camming surfaces 17 and 19 along a line of contact and thereby form a seal. The quality of this seal will vary with the accuracy of machining and the control of the parallel distance between the camming surface to cause it to match the length of the vanes.

Second, a portion 61 of each camming surface 17 or 19 is tangent to, or flat against partition 24. Adjacent that portion is a first, intake portion **52*a* from which the array of ports 52 vent as the camming surface diverges from partition 24. This is followed by a second, pressurizing portion 63 corresponding to that portion of the cam face most distant from partition 24, and a third, exhaust portion 64 adjacent exhaust ports 54 as the camming surface converges toward partition 24, finally culminating in a null portion 65 which continues into the initial tangential portion 61 previously noted. FIG. 4 illustrates three null portions namely portion 65 which portion spans between port 52*a* and exhaust port 54*a*, null portion 67 between port 52*b* and pressurized port 60 and null portion 69 between pressurized port 60 and exhaust port 54*b*. Moreover pressurizing portion 63 is defined as the region bounded by the outside edge in the clockwise direction of port 52*b* and the outside edge in the counter clockwise direction of the discharge grid at port 54*b*. Furthermore once the vanes 28 first clear the edge of the pressurized port 60 as they rotate in the clockwise direction as shown in FIG. 4 pressure from the pressurized port 60 will instantly fill the segment facilitating the merging and raising of the pressure of the low pressure incoming fluid. This pressure will affect the segment 63 that is in contact with the pressurized port 60. Accordingly, the pressurized port 60 will communicate with the pressurizing segment 63 sequentially in, relation to the pitch to pitch limits of the vanes 28 as they rotate. It should be noted that a portion of the same region on the inclined annulus is intermittently utilized as a null seating area 67** between the high and low pressure sides of the system. This region is designated by the angle alpha and coincides with the pitch of the segment therein.

It will be noted that shaft 22, vanes 28, camming surfaces 17 and 19, partition 24, and cylindrical manifold head 20 define, in the preferred embodiment, a total of 16 variable geometry chambers. One chamber 66, for example, has an inner arcuate wall formed by shaft 22, an outer arcuate wall formed by cylindrical manifold head 20, a first radial wall formed by vane **28*a* a second radial wall formed by vane 28*b*, an upper wall formed by partition 24, and a lower wall formed by camming surface 17**.

Commencing at the null portion 65 in which chamber 66 has no volume, as the rotor turns chamber 62 begins to expand. During this expansion phase chamber 66 passes across the first, intake portion of camming surface 17. Inlet ports 52 are deployed on an angular pitch of 11.5 degrees, and are of width greater than the thickness of vanes 28 such that at all times in which any chamber is expanding it is in fluid communication with at least one inlet port 52 and so can draw in working fluid.

As chamber 66 clears the last of inlet ports 52 it ceases to expand. There is a portion of travel corresponding to angle [alpha] in which chamber 66 is closed to all ports, and then it is exposed to pressurizing port 60. When so exposed the pressure prevailing in gallery 44 will be impressed upon the contents of chamber 66. There is a brief portion of travel corresponding to angle [Beta] in which chamber 66 is again sealed from all ports, and then it becomes exposed to the first of exhaust ports 54. Only after it has become exposed to the exhaust ports does chamber 66 begin to shrink as camming surface 17 converges toward partition 24. At all times while chamber 66 is decreasing in volume it communicates with at least one exhaust port 54. Finally there is a null period during which time partition 24 rides along the null portion 65 of camming surface 17 and chamber 62 has more or less no volume, and is exposed to neither inlet ports nor outlets ports.

The present inventor has coined the term "slip conversion" to describe the pressurization process which occurs within the present device. The compressor is started by motor 2. A pressure differential will soon develop across compressor 3 such that gallery 44 is at a high pressure relative to inlet passages 46 which will by reference be referred to as containing fluid at low pressure. The great majority of the pressurization occurs as chamber 66, in its constant volume phase, slips past pressurizing port 60, hence "slip conversion". The location of the exhaust ports 54 in the external walls is chosen in view of the inherent centrifugal tendency of the fluid to exit outwardly. In a standard reciprocating piston pump it is mechanical variation of the size of the chamber that causes an increase in pressure in the working fluid. The cyclomic unit is the pump or compressor 4 described above. The cyclothermic converter is the combination of the pump or compressor 4 operating in the system to be described in relation to FIGS. 1 and 2 as it applies to the hydraulic (FIG. 1) or thermal energy (FIG. 2). In the case of the cyclothermic unit it is the exposure of the fluid to the higher pressure fluid that pressurizes each subsequent chamber of liquid.

In the hydraulic embodiment shown in FIG. 1, a surge chamber, or accumulator 136 is used in conjunction with the differential pressure volume leveraging action of the fluid which is enabled by the low input requirements of the cyclonic unit through the power of slip conversion. The accumulation, may be used to maintain pressure on the high pressure side of the compressor, and to even out pressure fluctuations, or ripple, during operation. In the two phase refrigeration or air conditioning system of FIG. 2 these functions are performed within receiver 170.

Another component of the system of the present invention schematic shown in FIGS. 1 and 2 is the impeller 4 which is mechanically connected to compressor 3. In the schematic of FIG. 1 compressor 3 and impeller 4 are shown sharing a common shaft with the motor 2. The motor is linked to the compressor across a clutch 72. The compressor 3 and impeller 4 may be constructed in a single unit, linked across a clutch 73, or linked through a gearbox as may be desired. The output shaft of impeller 4 may also be connected to drive an external mechanical load, such as an evaporator or condenser fan. At all times it is intended that work output from impeller 4 be available for transmission back to the drive shaft of compressor 3. In normal operation the primary use of that work output is to drive compressor 3.

Impeller 4 is best illustrated in the cross-sections of FIGS. 5 and 6. The impeller comprises a stationary body 76 and a spool 78. Body 76 comprises a shell 80, being an upper shell 80*a*, a lower shell 80*b* and an annular collar 80*c* intermediate the upper and lower shells held by threaded fasteners such as cap screws 80*d* which compress gaskets 80*e*. Shell 80 is shown in section to reveal spool 78 which comprises a shaft 82 and a drum 84 located centrally thereon. Shaft 82 revolves about an axis 85, which in the case of a direct drive may coincide with axis 11.

Upper shell 80*a* and lower shell 80*b* are provided with a machined passage 86, bearings 87, and seals 88 to carry shaft 82. They are also provided with radially extending flanges 90*a* and 90*b* respectively, and an array of longitudinally extending discharge passageways 94 on 120 degree centres about axis 85. When collar 80*c* is located intermediate flanges 90*a* and 90*b* an inlet, or high pressure fluid annular manifold gallery 95 is defined between the inner cylindrical face of collar 80*c* and the outer cylindrical face of the body of upper shell 80*a* and lower shell 80*b*. Gallery 95 receives high pressure fluid through passageway 96 of inlet fitting 97 at which high pressure lines 9*a* may have a terminus. As best seen in FIG. 6, slots 99 have been cut through the walls of upper shell 80*a* and lower shell 80*b* to permit fluid communication with gallery 95. In the preferred embodiment three slots 99 are disposed on 120 degree centres, all 60 degrees out of phase with discharge passages 94. As with the previously described pressure port 60 of compressor 3, slots 99 are disposed at an angle, with one side of each slot more or less tangential to the outer diameter of drum 84 and the opposite side parallel thereto.

In the preferred embodiment drum 84 is machined in the form of a bobbin with sixteen oval pockets 100 equally spaced about its circumference. As drum 84 tums each pocket 100 is exposed in turn to one of slots 99 whence it is exposed to high pressure working fluid in gallery 95. Continued turning will rotate each pocket past a null portion 101 corresponding to the angle indicated as greek letter psi in FIG. 5, of cylindrical wall 102 during which it is exposed neither to slots 99 nor to discharge passages 94. Yet further turning will expose each pocket 100 to a low pressure discharge port 104 through which fluid may escape to one of discharge passages 94. Each discharge port 104 is relieved by chamfered edges 105 which promotes easier stripping of fluid from each pocket. One of the three lines of action of the impellor is indicated by the greek letter lambda in FIG. 6, located between two parallel dashed lines. This indicates the projection of pressure from gallery 95 through ports 99 to act on pockets 100. The radial depth of pockets 100 is greater than or equal to the width of ports 99. That portion of cylindrical wall 102 subtended by the chamfered edges 105 of one discharge port 104 is roughly equal to the projected width of line of action lambda, and will be exposed to lower, or discharge pressure. In the embodiment shown it is less than that width by the difference in the cosine of angle psi from unity, taken over the radius of drum 84.

It will be noted that pockets 100 continue to carry fluid throughout the cycle of rotation, and that the net flow from the inlet, high pressure side of the impeller to the outlet side of the impeller is relatively small, being only the surface layer of fluid. It will also be noted that it is important to achieve a close tolerance between the outer diameter of drum 84 and cylindrical wall 102 to prevent excessive seepage.

In the preferred embodiment both the intake ports 52 of compressor 3 and the discharge passages 94 of impeller 4 may both communicate with a common sump. It is foreseen that the entire assembly may be submerged in a reservoir such that a bath of intake fluid is available to compressor 3. As long as there is a pressure differential across impeller 4 it remains capable of returning work to drive compressor 3.

FIGS. 1 and 2 provide two different embodiments of the present invention. In FIG. 1 a purely hydraulic system is shown. The hydraulic system of FIG. 1 comprises the motor 2 linked to drive the cyclonic unit, or compressor 3, on start up. The compressor is in turn mechanically linked to the converter unit, or impeller 4. In this system one finds first, second, third, and fourth shut off valves 120, 122, 124, 126, and a relief valve 128. Also shown are a check valve 130, a differential pressure sensor 134, an accumulator 136, a pressurized expansion tank, reservoir, sump, or receiver 138, two flow sensing switches 140 and 142, and load 5, in this case an hydraulic motor and generator set 144.

Motor 2 is used to start the system. Initially valve 120 is open and all other valves are closed. Motor 2 tums compressor 3 and begins to draw down the pressure in the receiver 138 and load up the accumulator 136 with hydraulic oil. When the desired operating pressure differential is reached sensor 134 closes. As pressure continues to increase relief valve 128 opens, and fluid flows past upon sensing flow switch 140. Switch 140 closes, causing valve 126 to open, and lock itself open (so as to insure that there is a differential pressure across the impeller 4 to keep it rotating after preliminary charging) even if relief valve 128 subsequently closes. The resulting flow across impeller 4 returns work to compressor 3. In particular since a liquid is virtually incompressible, there is very little displacement of the liquid in impeller 4 when a high pressure is applied to the liquid. Therefore by removing a little liquid through the chamfered edges 105 the remaining pressure on the liquid will subsequently drop. This has been referred to above as stripping. This stripping allows the majority of the liquid to remain in the pockets 100 as it rotates resulting in a low G.M.P. to operate the impeller. The horse power required to keep the compressor 3 operating, would be relatively low because of the process or SLIP-CONVERSION referred to earlier. The compressor rather than using members to physically squeeze the fluid, slips and merges the low pressure liquid or fluid with the developed high pressure fluid, that is on the high side of the system. Thus the fluid is raised to a higher pressure by fluid to fluid contact and not by the members physically squeezing the fluid. The vanes 28 are then used to eject the fluid from the chamber after slip-conversion takes place. The effort to do so will be greatly reduced because one will not be working against a higher pressure while ejecting the fluid, but rather, the vanes will be within a neutrally high pressure area, between the conversion port and the discharge exhaust ports 54. Thus, a leveraging situation is set up with the volume of liquid operating the impeller 4 and the volume of liquid raised to a higher pressure by the compressor 3.

When valve 124 is opened the system will drive load 5. Flow through the load will activate switch 142, which confirms flow from the secondary load. Should pressure drop on the high side of the system sensor 134 will open valve 120, and, permit the compressor to draw more liquid from the receiver 138 and recharge the system with liquid after a short time delay, if pressure remains low motor 2 is reactivated. This will introduce more liquid into the system and subsequently re-establish system operating pressure.

The system can be shut down by opening valve 122, and by closing valves 120, 122 and 126 with a pressure in the system and motor 4 stopped. It is anticipated that such a system would be well suited to microprocessor control.

A two phase vapour cycle air conditioning and cyclothermic thermal example is shown in FIG. 2. In this system there are pressure regulators 150, 152, and pressure relief valve 154 which acts much like a regulator. Regulator 152 regulates the maximum pressure on the low side of the system while regulator 150 regulates the minimum pressure by passing hot gas to the low side of the system. Three way valves are shown as 156 and 158. A primary condenser is shown as 160, a secondary condenser, or sub-cooler is shown as 162, with a sub-cooling coil 164*a*, control thermostat 164*b*, and throttling valve 164*c* provided to co-operate therewith. An external heat absorbing evaporator is shown as 166 and load 5 is represented by a zone heat exchanger of the space to be heated or cooled is shown as 168. Other valves and sensors indicated will be described below. The system consist of three heat exchange devices.

1. A heat exchanger 168 in the controlled space. Heat exchanger 168 could represent a chiller or the like.
2. An outdoor evaporator 166 which serves two functions, namely: (a) thermal charging of the unit and (b) to absorb heat from the ambient air, so that it could be given up to the controlled space for heating as a function of the process or secondary load.
3. A primary condenser 160 located outside, to condense the vapour to a liquid during (a) thermal charging of the unit and (b) during the secondary process cooling mode.

The sub-cooler 162 sub-cools the high pressure liquid to a temperature corresponding to a pressure and temperature equal to or less than, the maximum pressure allowed on the low side of the system by regulator 152. This prevents the high pressure liquid from flashing to a vapour P13, L13 as it goes across the impeller 4. The receiver 170 acts as an accumulator with its gas-liquid phase.

The compressor 3 is coupled to the impeller 4 and the starter motor 2. The starter motor 2 establishes differential pressure, by pulling down the pressure on the low side of the system and raises the low side fluid to a higher pressure and temperature through fluid to fluid contact in the compressor 3 as explained by the process of slip-conversion.

The starter motor is then de-energized after the differential pressure is met and sub-cooler temperature is accomplished. High pressure subcooled liquid is brought to bear on the impeller 4 which would power it, so that it could return work to the compressor 3. This process is called thermal charging.

Thermal charging is the process of absorbing heat from the ambient air into the system by the process of vaporization. Thereafter the vapour is raised to a higher pressure and temperature by the compressor 3 through the process of slip-conversion. It is this higher temperature, that is ultimately being suspended in the thermal application of the invention described herein. When the high temperature acts on the liquid refrigerant, it causes the refrigerant to change its volume, ultimately creating a force on the container in which it is housed. This heat energy is controlled by rejecting the excess at the condenser.

The heat could be viewed as a lever which is acting on the refrigerant. A little heat energy applied, generates a tremendous hydrostatic force. It is this force we send across the impeller 4 to return work to the compressor 3 and suspend the differential pressure. When the system loses heat, the differential pressure drops and the system has to be thermally charged. Hence the term "Thermal Charging".

The refrigerant receiver 170 could then be viewed as an accumulator 136 in the hydraulic application.

Once accomplished, the secondary process is brought on line. The three way valves 156 and 158 directs the flow of refrigerant, either through the condenser or to the heat exchanger for heating and directs the condensed vapour or liquid back to the receiver 170.

In other words, initially motor 2 drives compressor 3 to draw from the low side of the system and set up a pressure differential much as with the hydraulic system previously described. Under normal conditions the refrigerant leaving the compressor is in a superheated gas state. It is fed to the primary condenser 160 through first three way valve 156. Saturated liquid refrigerant is collected in receiver 170. The converter unit is intended to work only with liquid phase refrigerant. Therefore, valve 176 will only open if temperature sensed at a thermostat 173 is low enough to ensure that the refrigerant is sub-cooled liquid. A small bleed flow across throttling valve 164*c* is allowed to flash, drawing heat from the subcooler to achieve this condition.

The system will operate in this manner without regard to whether a load is present or not, and is intended to establish a steady system operating pressure differential before any load is brought on line. This defines primary system operation or thermal charging. It is intended that the working fluid at the intake to compressor 3 be at a sufficiently high enthalpy that it will be predominantly or entirely gas when leaving compressor 3. If the enthalpy of the working fluid leaving impeller 4 is too low then working fluid may be bled across expansion valve 178, and through outdoor evaporator 166 where it is boiled off. Pressure regulator 150 is provided to permit hot gas to flow into low pressure piping 9*b* if the low side pressure falls below 5 psig above ambient. This is intended to keep the entire system at positive pressure and to reduce the possibility of contaminants leaking into the system. On particulary cold days the ambient temperature at evaporator 166 may be below the boiling point of the working fluid at 5 psig. In that case primary system operation is maintained by providing supplemental heat at outdoor evaporator 166, as symbolised by a candle. This need for supplementary heat may be avoided by choosing a working fluid with a low boiling temperature at the chosen low side pressure.

When cooling is desired, in addition to running in primary mode, at least some saturated liquid from receiver 170 is permitted to flow through valve 182 to heat exchanger 168. Gas leaving heat exchanger 168 flows through second three way valve 158 and regulator 152 back to the inlet side of compressor 3 where it is mixed with the vapour from the sub-cooler 162 and liquid from the impeller 4. The fluid is then raised to a higher pressure and temperature by the process of slip-conversion. Three way valve 156 is energized and fluid will enter condenser 160. The condensed liquid will flow back to the receiver 170 pass check valve 186 and liquid from the receiver will continue to feed the sub-cooler 162 through solenoid 174 and the process cooling solenoid 182, completing the cooling circuit.

When heating is desired hot gas from compressor 3 is directed through first three way valve 156, through valve 180, to heat exchanger 168, which now acts as a primary condenser that is giving up heat to the controlled space and condensing to a liquid. Outlet working fluid flows through second three way valve 158 and check valves 184, and 186, to collect in receiver 170. Liquid from receiver 170 flows through a valve 178 to outdoor evaporator 166 and thence back to low pressure piping 9*b*. Valve 157 is a safety device to relieve pressure to the condensor 160 from the hot gas line which feeds solenoid 180, in the event that three way valve 156 fails. Moreover heat will be absorbed by the evaporator 166 and if the ambient temperature is too low, to effectively absorb heat into the system. The supplementary heating, which is a low heat intensity natural gas unit gives up its heat in the air stream of the evaporator and provides an additional heat source. The low pressure gas flows back to regulator 152 and to the compressor 3 where slip-conversion raises the pressure and temperature of the gas. The cycle will continue until the heat requirement is satisfied. Once satisfied, the system reverts back to the standby mode and thermal charges as required.

While particular embodiments of the present invention have been described those skilled in the art will appreciate the principles of the present invention are not limited to those examples but encompass equivalents thereof.

I claim:

1. A reciprocating vane pump comprising:

a stator a rotor for riding within said stator;

said rotor comprising a partition having slots and slidable vanes for sliding engagement within those slots;

said stator assembly comprising first and second camming surfaces bracketing said partition;

said slidable vanes disposed intermediate, and for riding engagement of said camming surfaces;

said stator assembly having an inner wall and an outer wall and a gallery intermediate said inner and outer walls;

said camming surfaces each comprising at least an intake sector, a pressurizing sector, and an exhaust sector;

said stator assembly comprising a pressurizing port opening upon said pressurizing sector and communicating with said gallery whereby said pressurizing sector is exposed to pressure prevailing in said gallery.

2. The reciprocating vane pump of claim 1 wherein said pressurizing passage traverses said inner wall.

3. The reciprocating vane pump of claim 2 wherein said inner wall comprises an inner face and said pressurizing passage comprises a wall disposed tangentially to said inner face.

4. The reciprocating vane pump of claim 1 wherein said camming surfaces are a matched pair of longitudinally undulating spaced apart surfaces.

5. The reciprocating vane pump of claim 1 wherein said inner wall comprises radially extending outlet passages in fluid communication with said gallery and disposed adjacent said exhaust sector for carrying fluid from said exhaust sector to said gallery.

6. The reciprocating vane pump of claim 1 wherein said rotor comprises a shaft, and said partition is a radially extending, radially slotted disc disposed medially and concentrically with said shaft.

7. The reciprocating vane compressor of claim 1 wherein:

each said intake sector is adjacent a region of tangential contact of that camming surface with said partition and said intake sector having inlet ports communicating with a source of low pressure fluid;

each said exhaust sector is adjacent a region of tangential contact of that camming surface with said partition and said exhaust sector also adjacent a sector of said inner wall having at least one exhaust port communicating with said gallery, and said gallery having an high pressure outlet, said camming surface, said partition, said inner wall, said rotor and said vanes defining a succession of variable geometry rotating chambers whereby fluid is drawn into each of said chambers through said inlet ports, compressed by exposing each of said chambers to said pressurizing port, and expelled from said chambers through said exhaust port.

8. A longitudinally reciprocating vane compressor for drawing in a fluid from a low pressure source and expelling that fluid through a higher pressure discharge, said compressor comprising:

a stator;

a rotor for riding within said stator;

said stator comprising at least one camming surface;

said rotor comprising a set of longitudinally reciprocating vanes for riding upon said camming surface;

said camming surface comprising at least an intake sector, an exhaust sector and a null sector between said intake sector and said exhaust sector;

said stator comprising a pressurizing port adjacent said null sector, said pressurizing port being in fluid communication with said high pressure discharge, whereby said null sector is exposed to the pressure prevailing at said high pressure discharge.

9. The longitudinally reciprocating vane compressor of claim 8 wherein:

said stator comprises a chamber having a cylindrical wall and two matched profile spaced apart opposed camming surfaces concentric with that wall.

10. The longitudinally reciprocating vane compressor of claim 9 wherein:

said rotor comprises a shaft for mounting concentrically within said stator assembly, said shaft comprising a medial, slotted, radially extending partition captured between said camming surfaces;

said partition comprising radially extending slots;

said rotor comprising a set of longitudinally reciprocating vanes slidably disposed in said radially extending slots.

11. The longitudinally reciprocating vane compressor of claim 8 wherein:

each of said camming surfaces comprises an intake portion traversable by said vanes when fluid is being drawn in between an adjacent pair of said vanes from said source;

each of said camming surfaces comprises an outlet portion traversable by said vanes when fluid is being expelled from between an adjacent pair of said vanes to said discharge;

each of said camming surfaces comprises a null portion intermediate said inlet portion and said outlet portion; said null portion traversable by said vanes when the volume of fluid between an adjacent pair of said vanes is unchanging.

12. The reciprocating vane compressor of claim 8 wherein:

each said intake portion is adjacent a region of tangential contact of that camming surface with said partition and said intake portion having inlet ports communicating with a source of low pressure fluid;

each said exhaust portion is adjacent a region of tangential contact of that camming surface with said partition and said exhaust portion also adjacent a portion of said inner wall having at least one exhaust port communicating with said gallery, and said gallery having an high pressure outlet, said camming surface, said partition, said inner wall, said rotor and said vanes defining a succession of variable geometry rotating chambers whereby fluid is drawn into each of said chambers through said inlet ports, compressed by exposing each of said chambers to said pressurizing port, and expelled from said chambers through said exhaust port.

13. A mated vane compressor pump and impeller system for operation between a low pressure source of fluid and a high pressure fluid system said system comprising:

a vane compressor;

an impeller;

a linkage between said vane compressor and said impeller for interlinking the motion thereof;

said vane compressor comprising a compressor stator and a compressor rotor for riding therein;

said compressor rotor comprising a partition having slots and slidable vanes for sliding engagement within those slots;

said compressor stator assembly comprising first and second camming surfaces bracketing said partition;

said slidable vanes disposed intermediate, and for riding engagement of said camming surfaces;

said compressor stator having an inner wall and an outer wall and a gallery intermediate said inner and outer walls;

said camming surfaces each comprising at least an intake sector, a pressurizing sector, and an exhaust sector;

said compressor stator assembly comprising a pressurizing port opening upon said pressurizing sector and communicating with said gallery whereby said pressurizing portion is exposed to pressure prevailing in said gallery.

14. The mated vane compressor and impeller system of claim 13 wherein said impeller comprises:

an impeller stator and an impeller rotor for riding therein;

said impeller stator comprising an inner wall and an outer wall and an inlet manifold therebetween for receiving fluid from said high pressure system;

said impeller rotor comprising a drum, said drum comprising fluid pockets;

said impeller stator inner wall comprising at least one channel communicating with said manifold for carrying fluid to said drum;

said impeller stator comprising at least one outlet passage for discharging fluid from said drum to said source;

said impeller stator inner wall comprising an inner face having a least one intake portion, at least one outlet portion, and a null portion therebetween.

15. The vane compressor and impeller pair of claim 14 wherein said channel is disposed tangentially to said inner face.

16. The vane compressor and impeller system of claim 15 for use with a two phase air conditioning and heating system, that system comprising a zone heat exchanger, a primary condenser, an outdoor evaporator, and a receiver, the vane compressor and impeller system comprising:

a secondary condenser disposed to receive fluid from said high pressure system, said secondary condenser having subcooling means;

said secondary condenser having an outlet in fluid communication with said manifold whereby said manifold receives only fluid in a liquid state.

* * * * *

UNITED STATES PATENT AND TRADEMARK OFFICE

CERTIFICATE OF CORRECTION

PATENT NO. : 5,626,032
DATED : May 6, 1997
INVENTOR(S) : Ian G. Neblett

It is certified that error appears in the above-identified patent and that said Letters Patent is hereby corrected as shown below:

Column 3, lines 29-30 delete "Figure 1 is a schematic of a hydraulic pump system incorporating the present invention." and insert --Figure 1 is a schematic of a cyclothermic converter system, for use in a hydraulic system or application.--

Column 3, lines 32-33 delete "Figure 2 is a schematic of an air conditioning and heat pump system incorporating the present invention." and insert --Figure 2 is a schematic of a cyclothermic converter system, for use in a refrigeration and air conditioning system or application.--

Column 6, line 16 delete "in" and insert --after--.

Column 6, line 16 delete "is again".

Column 6, line 17 delete "sealed from all ports, and then it".

Column 6, line 41 change "cyclomic" to --cyclonic--.

Column 6, line 46 change "cyclothermic unit" to --cyclonic-unit--.

UNITED STATES PATENT AND TRADEMARK OFFICE

CERTIFICATE OF CORRECTION

PATENT NO. : 5,626,032
DATED : May 6, 1997
INVENTOR(S) : Ian G. Neblett

It is certified that error appears in the above-identified patent and that said Letters Patent is hereby corrected as shown below:

Column 9, line 34 delete "P13, L13" as these were not referred to in our response of June 12, 1996, page 5, line 8.

Signed and Sealed this

Second Day of September, 1997

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,626,032
DATED : May 6, 1997
INVENTOR(S) : Ian Glenn Neblett

It is certified that error appears in the above-indentified patent and that said Letters Patent is hereby corrected as shown below:

Column 6, line 16 delete "in" and insert --after--.

Column 6, line 16 delete "is again".

Column 6, line 17 delete "sealed from all ports, and then it".

Column 6, line 41 change "cyclomic" to --cyclonic--.

Column 6, line 46 change "cyclothermic unit" to --cyclonic-unit--.

Signed and Sealed this

Fourteenth Day of October, 1997

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,626,032
DATED : May 6, 1997
INVENTOR(S) : Ian G. Neblett

It is certified that error appears in the above-identified patent and that said Letters Patent is hereby corrected as shown below:

The Title page should be deleted and substitute therefor the attached title page.

Drawings:

Delete Figures 1, 2 and 4 and substitute therefor the Figures 1, 2 and 4 as shown on the attached sheet.

Signed and Sealed this

Eleventh Day of November, 1997

*Attest:*

Bruce Lehman

BRUCE LEHMAN

*Attesting Officer*

*Commissioner of Patents and Trademarks*

United States Patent [19]

Neblett

[11] Patent Number: 5,626,032

[45] Date of Patent: May 6, 1997

[54] CYCLOTHERMIC CONVERTER VANE PUMP AND IMPELLER SYSTEM

[76] Inventor: Ian G. Neblett, 125 Terrosa Road, Markham, Ontario, Canada, L3S 2R1

[21] Appl. No.: 467,978

[22] Filed: Jun. 6, 1995

[51] Int. Cl.[6] ..... F01C 1/00; F25B 1/00

[52] U.S. Cl. ..... 62/513; 62/116; 418/219

[58] Field of Search ..... 418/219, 228–232; 62/116, 513

[56] References Cited

U.S. PATENT DOCUMENTS

| | | | |
|---|---|---|---|
| 1,743,977 | 1/1930 | Petersen | 418/219 |
| 3,902,829 | 9/1975 | Burrowes | 418/219 X |
| 4,028,028 | 6/1977 | Fuchs, Jr. | 418/232 X |

*Primary Examiner*—William E. Wayne
*Attorney, Agent, or Firm*—Eugene J. A. Gierczak

[57] ABSTRACT

A system having a matched vane compressor and impeller is described for use in either a hydraulic system or in a two phase air conditioning system. The impeller is matched to the compressor to return work to the compressor through a shaft or gearbox. The compressor is a vane compressor having longitudinally reciprocating vanes carried in a slotted disc between matched, opposed cam faces forming a series of variable geometry chambers which draw in and expel working fluid during rotation of the shaft. Compression is achieved by exposing the fluid in the chambers to high pressure fluid while the volume of the chamber is not changing. A pressurizing port is placed tangentially to the chambers for this purpose. The impeller also makes use of tangentially disposed pressure ports to expose the turning pockets of a drum to higher pressure. The outlet of the impeller only skims off a surface layer of the liquid in the pockets, reducing the volumetric through flow of the impeller while it returns work to the compressor. These systems can be utilized in hydraulic or thermal applications.

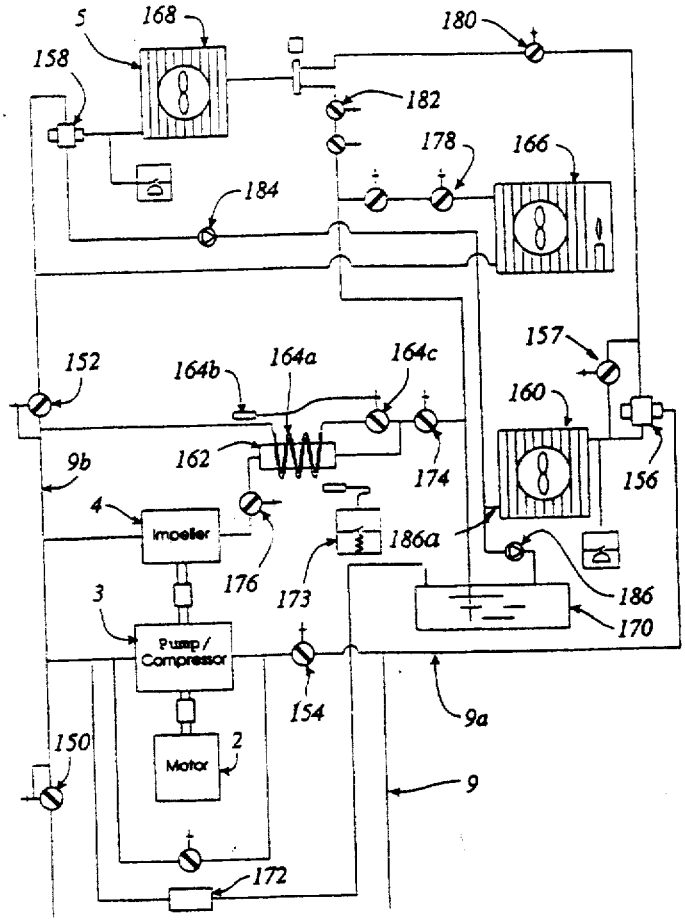

16 Claims, 8 Drawing Sheets